US011708708B1

(12) United States Patent
Scoggin

(10) Patent No.: US 11,708,708 B1
(45) Date of Patent: Jul. 25, 2023

(54) SECURING DEVICE FOR TOOLS AND OTHER OBJECTS

(71) Applicant: David Scoggin, Palestine, TX (US)

(72) Inventor: David Scoggin, Palestine, TX (US)

( * ) Notice: Subject to any disclaimer, the term of this patent is extended or adjusted under 35 U.S.C. 154(b) by 0 days.

(21) Appl. No.: 17/845,774

(22) Filed: Jun. 21, 2022

Related U.S. Application Data

(60) Provisional application No. 63/323,724, filed on Mar. 25, 2022.

(51) Int. Cl.
*E05B 75/00* (2006.01)
*E05B 73/00* (2006.01)

(52) U.S. Cl.
CPC ..... *E05B 73/0005* (2013.01)

(58) Field of Classification Search
None
See application file for complete search history.

(56) References Cited

U.S. PATENT DOCUMENTS 4,598,827 A * 7/1986 Keifer ..... E05B 69/006 70/59
4,956,982 A * 9/1990 Valley ..... E05B 67/383 70/59
5,345,947 A * 9/1994 Fisher ..... A61F 5/3715 128/878
6,360,747 B1 * 3/2002 Velarde ..... E05B 75/00 128/869
7,581,416 B1 * 9/2009 Lenertz ..... E05B 75/00 119/770
2010/0122560 A1 * 5/2010 Ricker ..... A45C 13/20 70/64

OTHER PUBLICATIONS

International Search Report Issued in International Application Nop. PCT/US2023/015408 dated Apr. 19, 2023.
Written Opinion Issued in International Application Nop. PCT/US2023/015408; dated Apr. 19, 2023.

* cited by examiner

*Primary Examiner* — K. Wong
(74) *Attorney, Agent, or Firm* — Ferguson Case Orr Paterson

(57) ABSTRACT

This disclosure relates generally to securing/locking devices that enable the securing of multiple valuable items, such as tools, sporting equipment, and the like. Embodiments of securing/locking devices can include a primary link member such as a chain, rope, wire, or cable that connects a junction to a primary securing member, such as a cuff. The devices can further include secondary link members each connecting the junction to one or more secondary securing members. The primary link member can attach the device to an anchor, such as a trailer, a truck bed rail, a portion of a house, or similar. The secondary link members can attach the device to mobile objects, such as expensive tools and sporting equipment. Thus, the single securing/locking device can be used to secure multiple mobile objects to a relatively stationary anchor. Many different embodiments similar to or different than this specific securing device are possible.

20 Claims, 4 Drawing Sheets

SECURING DEVICE FOR TOOLS AND OTHER OBJECTS

CROSS-REFERENCE TO RELATED APPLICATIONS

The present application claims the priority benefit of U.S. Provisional Patent App. No. 63/323724 to Scoggin, filed on Mar. 25, 2022 and entitled "Securing Device for Tools and Other Objects," the entire contents of which are hereby incorporated by reference.

BACKGROUND OF THE DISCLOSURE

Field of the Disclosure

Embodiments of the present disclosure relate to devices for securing items, such as tools and sporting equipment.

Related Art

FIG. 1 shows a prior art Model 8290DPS Street Cuff locking device 100 available from Master Lock Company, LLC of Oak Creek, Wisconsin. The locking device 100 includes two cuffs 102 and a link 104, such as a chain or cable. The locking device 100 can be used to secure a first item to a second item. For instance, one cuff portion 102 can attach to a side rail in a truck bed, a trailer, or similar while the other cuff portion 102 can attach to an expensive piece of equipment, such as construction or sporting equipment, to secure the expensive piece of equipment to the truck bed, thus lowering the chance of theft. The locking device 100, however, can most often only be used to secure a single item at a time.

SUMMARY OF THE DISCLOSURE

One embodiment of a securing device according to the present disclosure comprises a junction, a primary securing member, and a primary link member connecting the junction and the primary securing member. The securing device further comprises a plurality of secondary securing members, and a plurality of secondary link members each connecting one of the secondary securing members to the junction.

One embodiment of a method according to the present disclosure of securing a plurality of mobile objects using a securing device comprises attaching a primary securing member of a securing device to an anchor and/or stationary object, and attaching each of a plurality of secondary securing members of the securing device to a respective one or more of a plurality of mobile objects. The securing device comprises the primary securing member, the secondary securing members, a junction, a primary link member connecting the primary securing member to the junction, and a plurality of secondary link members each connecting a respective one or more of the secondary securing members to the junction.

This has outlined, rather broadly, the features and technical advantages of the present disclosure so that the detailed description that follows may be better understood. Additional features and advantages of the disclosure will be described below. It should be appreciated by those skilled in the art that this disclosure may be readily utilized as a basis for modifying or designing other structures for carrying out the same purposes of the present disclosure. It should also be realized by those skilled in the art that such equivalent constructions do not depart from the teachings of the disclosure as set forth in the appended claims. The novel features, which are believed to be characteristic of the disclosure, both as to its organization and method of operation, together with further features and advantages, will be better understood from the following description when considered in connection with the accompanying figures. It is to be expressly understood, however, that each of the figures is provided for the purpose of illustration and description only and is not intended as a definition of the limits of the present disclosure.

DETAILED DESCRIPTION OF THE DISCLOSURE

Figure 1A:
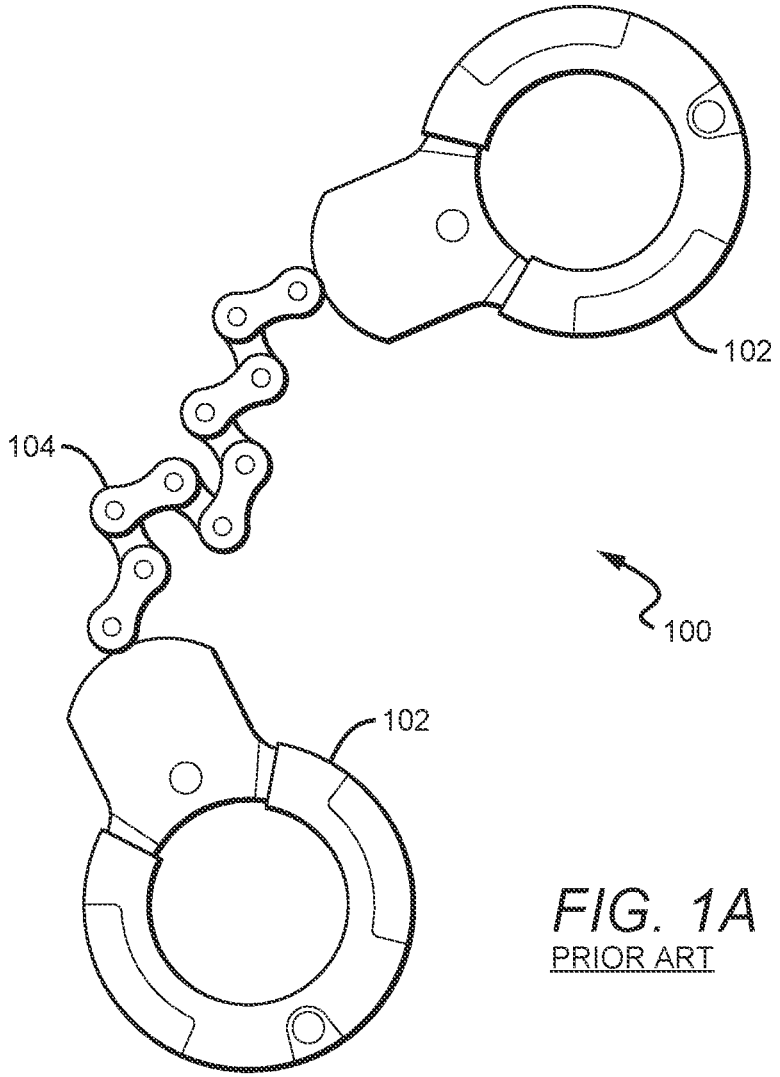
FIG. 1A PRIOR ART
FIG. 1A shows a prior art securing device.

This disclosure relates generally to securing/locking devices that enable the securing of multiple valuable and/or dangerous items, such as tools, sporting equipment, firearms, and the like. Embodiments of securing/locking devices according to the present disclosure can include a primary link member such as a chain, rope (e.g. normal rope, steel rope, etc.), wire, or cable that connects a junction to a primary securing member, such as a cuff. The devices can further include a plurality of secondary link members each connecting the junction to one or more respective secondary securing members. The primary link member can attach the device to an anchor, such as a truck bed rail, a portion of a house or garage, or similar. The secondary link members can attach the device to mobile objects, such as expensive tools, sporting equipment, and the like. Thus, the single securing/locking device can be used to secure multiple mobile objects to a relatively stationary and/or heavier anchor. Many different embodiments similar to or different than this specific securing device are possible.

Embodiments of the disclosure are described herein with reference to illustrations that are schematic illustrations of embodiments of the disclosure. As such, the actual size, components and features can be different, and variations from the shapes of the illustrations as a result, for example, of technological capabilities, manufacturing techniques and/or tolerances are expected. Embodiments of the disclosure should not be construed as limited to the particular shapes or components of the regions illustrated herein but are to include deviations in shapes/components that result, for example, from manufacturing or technological availability. The regions illustrated in the figures are schematic in nature and their shapes are not intended to illustrate the precise shape or functionality of a feature of a device and are not intended to limit the scope of the disclosure. In addition, components may be shown as one unit but may instead be a collection of components or units, or a collection of components or units may exist as one unit.

Throughout this description, the preferred embodiment and examples illustrated should be considered as exemplars, rather than as limitations on the present disclosure. As used herein, the terms "disclosure," "device," "method," "present disclosure," "present device" or "present method" refers to any one of the embodiments of the disclosure described herein, and any equivalents. Furthermore, reference to various feature(s) of the "disclosure," "device," "method," "present disclosure," "present device" or "present method" throughout this document does not mean that all claimed embodiments or methods must include the referenced feature(s).

It is also understood that when an element or feature is referred to as being "on" or "adjacent" another element or feature, it can be directly on or adjacent to the other element or feature, or intervening elements or features may also be present. It is also understood that when an element is referred to as being "connected" or "coupled" to another element, it can be directly connected or coupled to the other element, or intervening elements may be present. In contrast, when an element is referred to as being "directly connected" or "directly coupled" to another element, there are no intervening elements present.

Relative terms such as "outer," "above," "lower," "below," "horizontal," "vertical" and similar terms, may be used herein to describe a relationship of one feature to another. It is understood that these terms are intended to encompass different orientations in addition to the orientation depicted in the figures.

Although the terms first, second, etc. and similar terms such as primary, secondary, etc. may be used herein to describe various elements or components, these elements or components should not be limited by these terms. These terms are only used to distinguish one element or component from another element or component. Thus, a first element or component discussed below could be termed a second element or component without departing from the teachings of the present disclosure. As used herein, the term "and/or" includes any and all combinations of one or more of the associated list items.

The terminology used herein is for describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," when used herein, specify the presence of stated features, integers, steps, operations, elements, and/or components, but do not preclude the presence or addition of one or more other features, integers, steps, operations, elements, components, and/or groups thereof.

Figure 2:
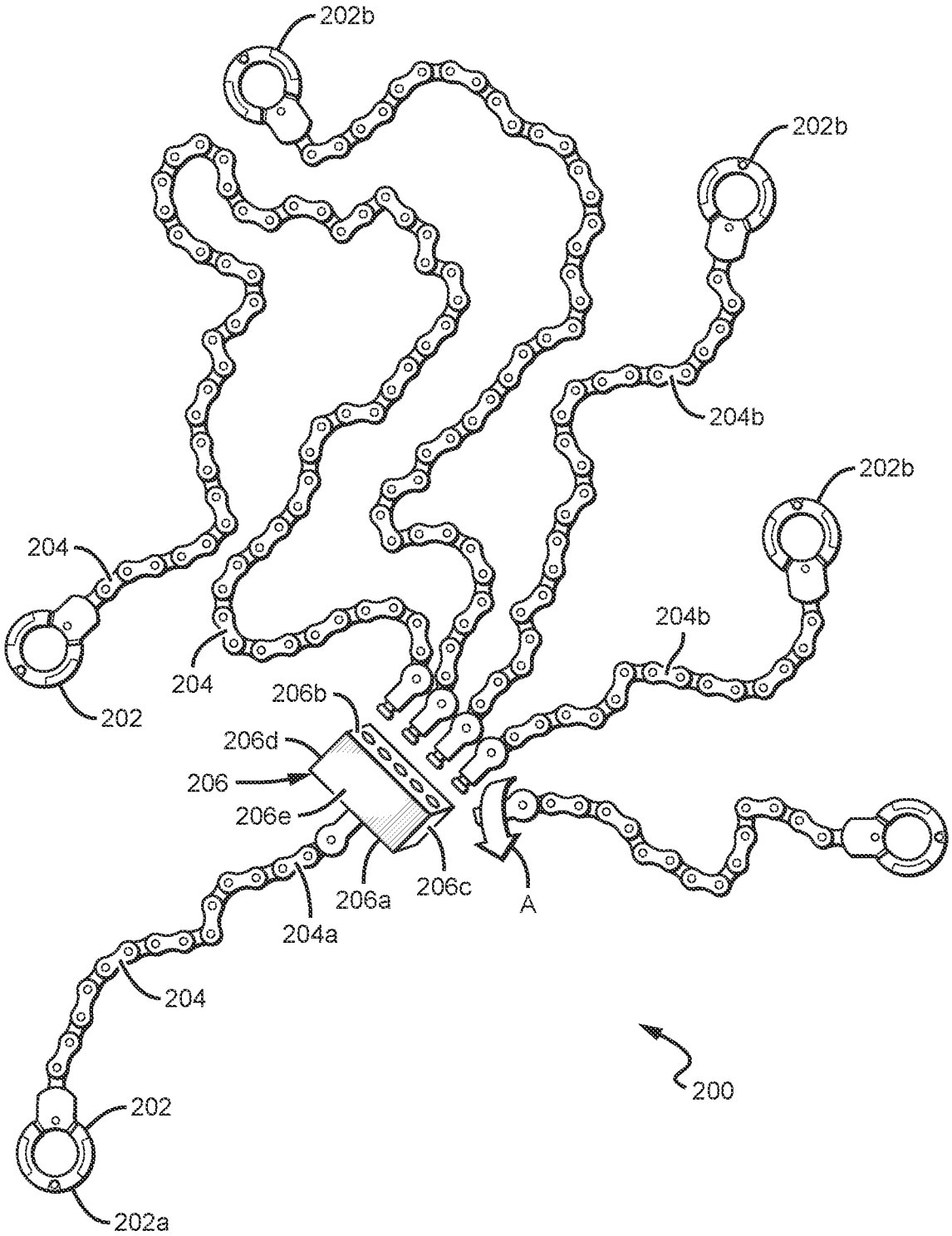
FIG. 2 shows a securing device according to one embodiment of the present disclosure.

FIG. 2 shows a securing/locking device 200 ("securing device" and "locking device" used interchangeably herein for simplicity) according to the present disclosure. The locking device 200 can include a plurality of securing members 202 (e.g., cuffs) and a plurality of link members 204 (e.g., chains, cables, ropes, wires, or similar). The locking device 200 can also include a junction 206. The junction 206 can be, e.g., a junction box or junction block, and can serve to connect to the various link members 204.

In the specific embodiment shown, the locking device 200 includes one primary securing member 202*a* and one primary link member 204*a* connecting the junction 206 to the primary securing member 202*a*. The locking device 200 also includes five secondary securing members 202*b* and five secondary link members 204*b*. The ratio of securing members 202 to link members 204 (and/or primary securing members 202*a* to primary link members 204*a*, and/or secondary securing members 202*b* to secondary link members 204*b*) can be 1:1 as in this embodiment, though it is understood that different embodiments are possible. It is also understood that any number of secondary securing members 202*b* and/or secondary link members 204*b* is possible, such as two, three, four, five (as shown), or more. It can be advantageous to have two or more secondary securing members 202*b* and link members 204*b* so that the locking device 200 can secure multiple items. Embodiments other than that shown are possible. For instance, in some embodiments, one or more of the securing members 202 are each associated with two or more link members 204 for extra security, and the link members 204 for each securing member 202 can be of the same or different type (e.g. both chain, one chain and one cable, both cable, etc.).

In the specific embodiment shown, the locking device 100 is designed to connect to an anchoring object, such as a building, house, trailer, or truck (e.g., to a rail in a truck bed). The anchoring object is typically more stationary and/or heavier than the other objects to which the locking device connects (referred to herein as "mobile objects" for simplicity). Anchoring objects according to the present disclosure can be, for example, 100 lb or more, 250 lb or more, 500 lb or more, 1000 lb or more, 2000 lb or more, or 5000 lb or more, though these weights are exemplary in nature only. The connection to the anchoring object can be made using the primary securing member 202*a* and primary link member 204*a*. In some embodiments, an anchoring object can comprise a primary and/or heavier object (such as a truck) and a connection object, such as a rail, connected to the heavier object. One such example is a high strength eye-bolt and rail attached to a bed of a truck or to a trailer. The plurality of secondary securing members 202*b* and secondary link members 204*b* can be used to secure mobile objects which may typically be more easily stolen, more mobile, and/or lighter, such as, for instance, construction equipment, sporting equipment, luggage, or firearms. The mobile objects can be, by way of example only, 500 lb or less, 250 lb or less, 150 lb or less, 100 lb or less, 75 lb or less, or 50 lb or less. In one embodiment, the primary link member 204*a* is thicker, stronger, and/or sturdier than the secondary link members 204*b* in order to lessen the chance of rupture of the primary link member 204*a* such that all mobile objects can be taken at once without rupturing any of the secondary link members 204*b*. In another similar embodiment, two or more primary link members are used, so as to add extra reinforcement, either with or without additional primary securing members. It is understood that while FIG. 2 specifically identifies elements 202*a* and 204*a* as the primary securing and link members, any of the securing and link members shown could serve as the primary securing and link members, and/or connect to an anchoring object. Moreover, for extra security, multiple link member/securing member combinations could be connected to an anchoring object for extra security.

While the specific embodiment shown includes cuffs as the securing members 202, it is understood that some or all of the securing members 202 can be different types of securing members, such as, without limitation, U-locks, combination locks, and other embodiments as would be understood by one of skill in the art.

In the specific embodiment shown, the securing members 202 are keyed securing members. In one embodiment, all securing members 202 are keyed the same (i.e., are lockable and unlockable by the same common key). In another embodiment, the secondary securing members 202*b* are all keyed the same. In another embodiment, the secondary securing members 202*b* are all keyed in one manner, while the primary securing member 202*a* is keyed in a different manner. In another embodiment, all of the securing members 202 are keyed differently. Many different embodiments are possible. Moreover, the term "keyed" as used herein should be understood in a broad sense to refer to different types of locking mechanisms, methods, and apparatus, such as combination locks.

Many different lengths of link members 204 are possible. In one embodiment, two or more secondary link members 204 have lengths differing by 6" or more, or 12" or more, or 18" or more, or 24" or more; in another embodiment, three or more secondary link members 204*b* have lengths differing from each other by 6" or more, or 12" or more, or 18" or more, or 24" or more; in another embodiment, four or more secondary link members 204*b* have lengths differing from each other by 6" or more, or 12" or more, or 18" or more, or 24" or more; in another embodiment, five or more secondary link members 204*b* have lengths differing from each other by 6" or more, or 12" or more, or 18" or more, or 24" or more. In the specific embodiment shown, the primary link member 204*a* is approximately 8" to 24" long, while the secondary link members 204*b* are approximately 12"±3", 24"±3", 36"±3", 48"±3", and 60"±3" long, respectively. Many different embodiments are possible. The inclusion of secondary link members 204*b* of different length can be advantageous in that it can permit easier storage of the various items that the secondary securing members 202*b* are connected to, such as by spacing them out from one another (e.g., in a truck bed).

In the embodiment of FIG. 2, the junction 206 is a junction box that includes six attachment points, though different embodiments are possible. In this embodiment, the primary link member 204*a* connects to a first side 206*a* of the junction 206 while the secondary link members 204*b* connect to a second side 206*b* of the junction 206 opposite the first side 206*a*. In another embodiment, secondary link members 204*b* connect to the junction 206 at the second side 206*b*, and/or at third and/or fourth sides 206*c*, 206*d* between the first and second sides 206*a*, 206*b*. In such an embodiment, the third and/or fourth sides 206*c*, 206*d* can each be adjacent the first and/or second sides 206*a*, 206*b*. In one embodiment, a link member 204 (e.g. a primary link member 204*a* or secondary link member 204*b*) can extend upward or downward out of the junction 206 (e.g., for an upwardly extending link member 204, out of the top side 206*e*). In one embodiment, six or more sides of a junction each have one or more link members connecting to it. In one embodiment, a single side has both the primary link member 204*a* and one or more secondary link members 204*b* connecting to it. Many different embodiments are possible.

Figure 1B:
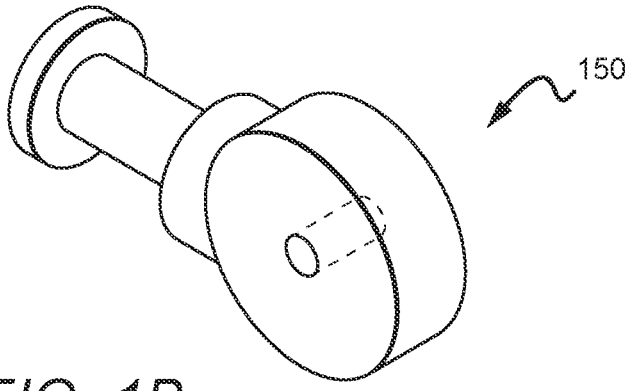
FIG. 1B PRIOR ART
FIG. 1B shows a prior art swivel pin.

The connection between the junction 206 and the link members 204 can be designed to make rupture more difficult. For instance, the connection can be a swivel connection enabling 360° rotation as shown by "A" in FIG. 2, thus reducing or eliminating the possibility of disconnecting the link members 204 from the junction 206 via rotational force in the direction of A. This can be accomplished using, for instance, a connection using the prior art swivel pin 150 shown in FIG. 1B. Similarly, the connection between the link members 204 and securing members 202 can also be a swivel connection. These swivel connections can be particularly useful for embodiments where the link members 204 comprise chains, which can be particularly susceptible to torsion.

Embodiments of the present disclosure can use and/or be made of many different materials. For example, the securing members 202, link members 204, and/or junction box 206 could be metal, rubber, polymer, plastic, or other materials as known in the art. Additional materials can also be used in order to prevent damage to items to which the securing devices are attached. For instance, rubber, silicone, nylon, or another soft material can be used in conjunction with the securing members 202 and/or the link members 204, which could be metal, in order to prevent scratching or other damage. Additionally, the link members 204, while shown as flexible, could also be rigid, such as in an embodiment with one or more pole and/or rod link members. Many different embodiments are possible.

Figure 3:
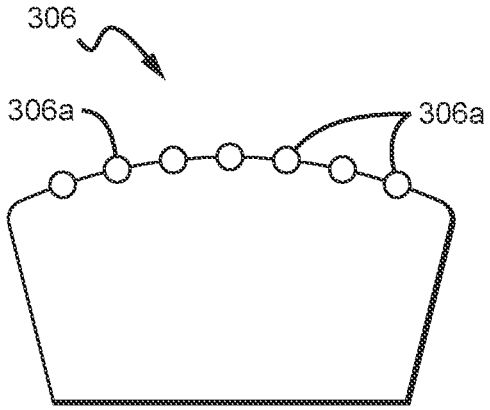
FIG. 3 shows a securing device junction according to one embodiment of the present disclosure.
Figure 4:
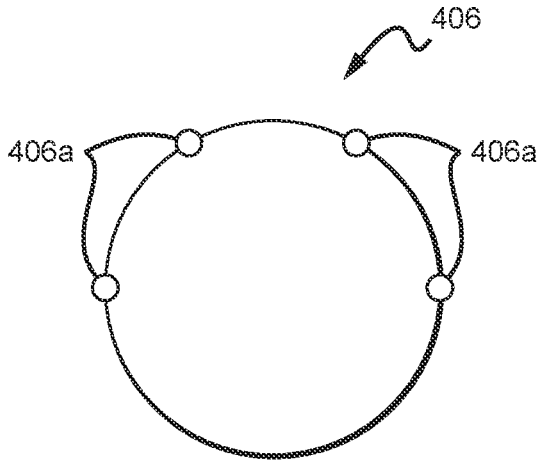
FIG. 4 shows a securing device junction according to another embodiment of the present disclosure.

While FIG. 2 shows one embodiment of a junction 206, many different embodiments and shapes are possible. For instance, FIG. 3 shows a junction 306 with a shape and/or cross-section having a roughly trapezoidal bottom portion with a curved and/or convex top surface (a convex surface as described herein including but not limited to a curved convex surface and a combination of surfaces, such as flat surfaces, forming an overall convex shape). Exemplary attachment points 306*a* (e.g., apertures, though other types of attachment points are possible) can be used for connections to link members such as those described above. Other attachment points are possible, such as a primary attachment point on the bottom surface. The curved and/or convex top surface can be beneficial in that it can result in link members angling away from one another as they extend outward from the junction 306, which can help in preventing mobile objects from ending up on top of one another. Similarly, FIG. 4 shows a junction 406 having a generally circular shape and/or cross-section and exemplary attachment points 406*a*, which can enable link members to extend outward from an approximately semi-circular top surface (which is also a convex curved surface). Again, additional attachment points are possible, such as a primary attachment point approximately at the bottom quadrant. Many different embodiments are possible. Moreover, in another embodiment, attachment apertures of the junction to which link members connect can be angled such that the link members angle away from one another as they extend away from the junction. Attachment point arrangements can be symmetrical or asymmetrical. Many different embodiments are possible.

Figure 5A:
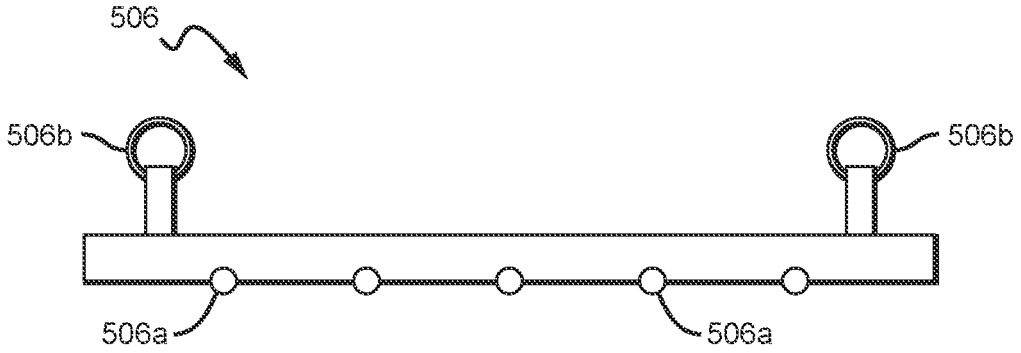
FIG. 5A shows a securing device junction according to yet another embodiment of the present disclosure.

Another embodiment of a junction 506 is shown in FIG. 5A. In this embodiment, the junction 506 is relatively flat compared to the versions previously shown, and can be a bar, a plate, or a sheet, and/or can be linear in nature. The junction 506 can include attachment points 506*a*. Additionally, the junction 506 (and other junctions described herein) can include attachment mechanisms, such as the attachment mechanisms 506*b*. The attachment mechanisms 506*b* can help to attach the junction 506 to an anchor (e.g., a ceiling, a trailer, a truck bed, etc.). In one embodiment, the attachments 506*b* can be eye-bolts, though other embodiments are possible.

Figure 5B:
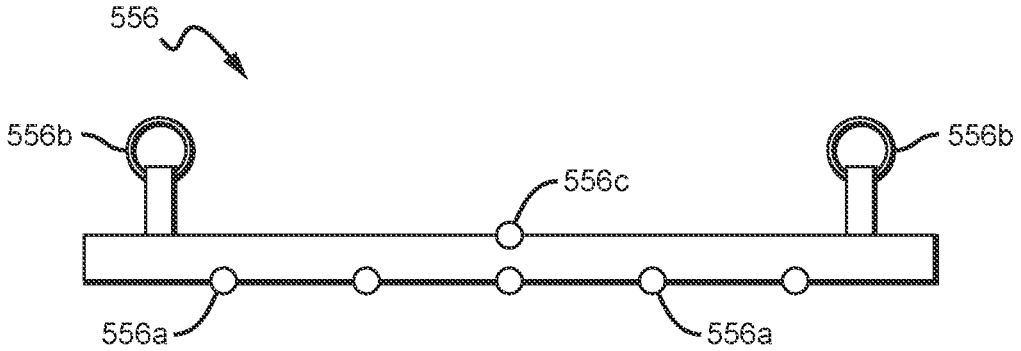
FIG. 5B shows a securing device junction according to yet another embodiment of the present disclosure.

Yet another embodiment of a junction 556 is shown in FIG. 5B. The junction 556 can be similar to the junction 506. In this specific embodiment, in addition to the attachment points 556*a*, the junction 556 can also include an attachment point 556*c*, which can be, for instance, on the top or side (e.g., front or rear) of the junction 556. A link member such as those previously described can run from the attachment point 556*c* and can attach the junction 556 to an anchor (e.g., a ceiling, a trailer, a truck bed, etc.). The attachments 556*b*, such as eye-bolts, can be used for weight support, such as by running a chain or other mechanism from the attachments 556*b* to the anchor. One or more link member/securing member combinations running from the attachment point 556*c* can serve as the primary securing apparatus.

Figure 6:
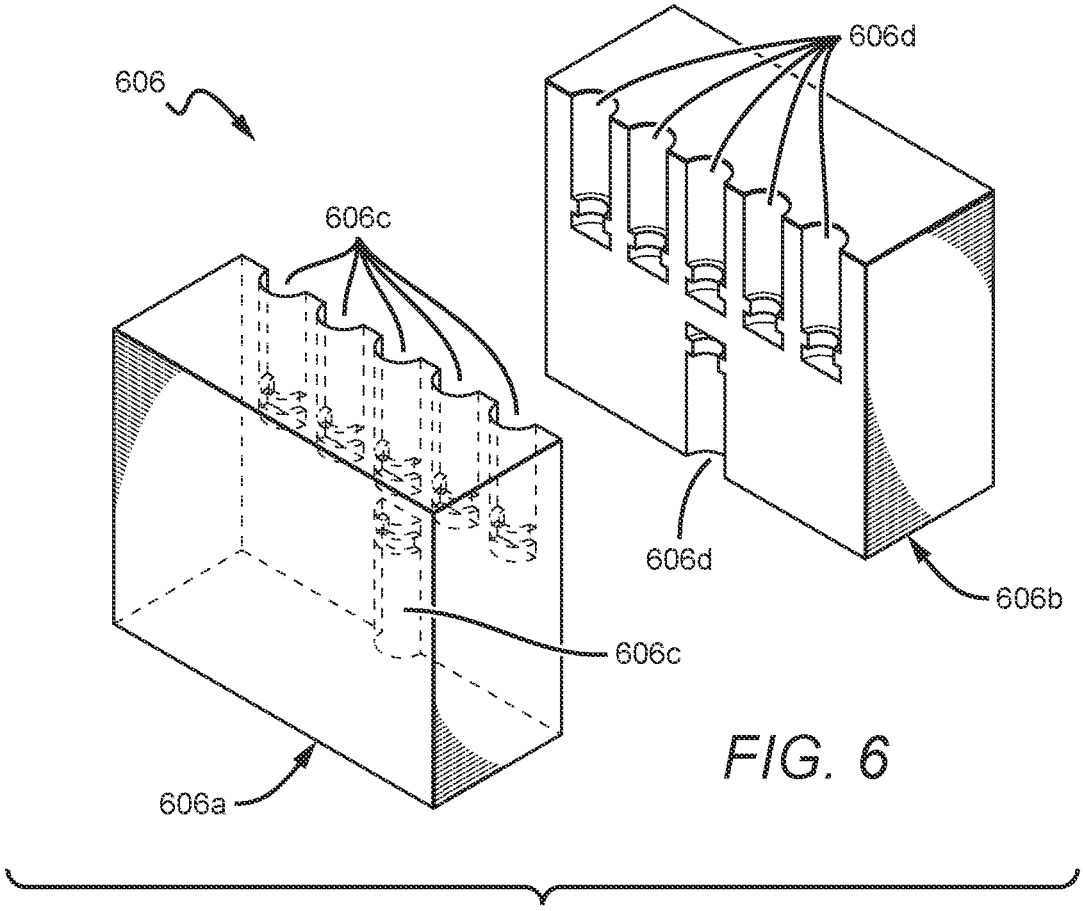
FIG. 6 shows a securing device junction according to yet another embodiment of the present disclosure.

Junctions according to the present disclosure can include multiple portions, which can enable easier connection to link members. For instance, FIG. 6 shows a square/rectangular junction 606 that is made up of two primary portions 606*a*, 606*b*. The junction part 606*a* can include aperture portions 606*c* while the junction part 606*b* can include aperture portions 606*d*, with the aperture portions 606*c*, 606*d* forming full apertures when the junction portions 606*a*, 606*b* are connected to one another. In one embodiment, link member connection portions are placed in position prior to the connection of the junction portions 606*a*, 606*b*, such that the link member connection portions are sandwiched between the two connected junction portions 606*a*, 606*b*. In one embodiment, the junction portions 606*a*, 606*b* are permanently connected to one another. However, in another embodiment this connection may not be permanent, and instead may be, for instance, keyed. Thus, a user could disconnect the two portions 606*a*, 606*b* from one another, and remove one link portion and replace it with another, adding customizability. Many different embodiments are possible. Additionally, it should be understood that various different aperture and connector/pin shapes are possible, often with the aperture sized and shaped to fit the connector/pin as would be understood by one of skill in the art.

Figure 7:
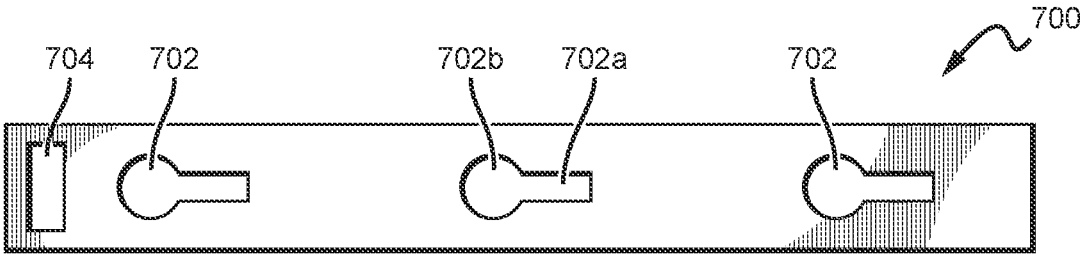
FIG. 7 shows a lock component according to one embodiment of the present disclosure.

The connection between a junction and link members can be permanent, such as with a locking device that has a junction stamped with the link members permanently therein. In another embodiment, the link members can be removable, such as via a key or similar. A keying functionality can be accomplished in many different manners. For instance, in one manner a lock component such as the lock bar 700 shown in FIG. 7 can be used. When the lock bar is in a first position, connectors such as the swivel pins 150 can be in the small portions 702*a* of the apertures 702, and having a larger cross-section than the small portions 702, be secured. When the position of the lock bar 700 is unlocked (e.g., by removing a lock piece from a slot such as the slot 704, such as by a keying functionality/mechanism), the lock bar 700 can be moved (e.g., slide) such that the connectors can be removed from the large portions 702*b* of the apertures 702. In this way, link members can be removed and replaced with alternative link members which may be more suitable for a user's intended purpose. The lock bar 700 can be included in and/or attached to a larger body or housing. In some instances the lock bar may include a pull tab or similar to assist with sliding. Another functionally similar embodiment is a cylindrical embodiment where when unlocked a mechanism can be rotated such that connectors (such as swivel pins 150) can be removed from larger portions of apertures (such as apertures 702 or similar). It should be understood that these embodiments are exemplary in nature, and other locking/unlocking functionalities and mechanisms can be included as would by understood by one of skill in the art.

Although the present disclosure has been described in detail with reference to certain preferred configurations thereof both in the specification and in the claims, other versions are possible. Embodiments of the present disclosure can comprise any combination of compatible devices/features described herein and/or shown in the figures, and these embodiments should not be limited to those expressly illustrated and discussed. For instance and not by way of limitation, the appended claims could be modified to be multiple dependent claims so as to combine any combinable combination of elements within a claim set, or from differing claim sets. The spirit and scope of the disclosure should not be limited to the versions described above.

The foregoing is intended to cover all modifications and alternative constructions falling within the spirit and scope of the disclosure as expressed in the appended claims, wherein no portion of the disclosure is intended, expressly or implicitly, to be dedicated to the public domain if not set forth in the claims.

I claim:

1. A securing device for tools or similar objects, comprising:

a junction;

a primary securing member;

a primary link member connecting said primary securing member to said junction, said primary link member comprising a chain or cable;

a plurality of secondary securing members; and a plurality of secondary link members, each of said secondary link members connecting one of said secondary securing members to said junction.

2. The securing device of claim 1, wherein said primary securing member and said secondary securing members are cuffs.

3. The securing device of claim 1, wherein said secondary link members are chains or cables.

4. The securing device of claim 1, wherein said primary link member connects to a first side of said junction, and wherein each of said secondary link members connects to a second side of said junction opposite said first side.

5. The securing device of claim 1, wherein a first of said secondary link members is at least 6" longer than a second of said secondary link members.

6. The securing device of claim 1, comprising at least five secondary securing members and at least five secondary link members.

7. The securing device of claim 6, wherein said five secondary link members have lengths that are at least 6" apart from one another.

8. The securing device of claim 6, wherein said five secondary link members have lengths that are at least 12" apart from one another.

9. The securing device of claim 7, wherein said primary link member is 8" to 24" long.

10. The securing device of claim 7, wherein said primary link member is longer than at least three of said five secondary link members.

11. The securing device of claim 1, wherein said junction comprises a convex surface, and wherein each of said secondary link members connects to said convex surface of said junction.

12. The securing device of claim 1, wherein said junction comprises a curved surface, and wherein each of said secondary link members connects to said curved surface of said junction.

13. The securing device of claim 1, wherein said junction is substantially circular.

14. The securing device of claim 1, wherein said junction comprises at least three sides with one or more of said secondary link members connected thereto.

15. The securing device of claim 1, wherein said junction comprises first and second junction portions, wherein said primary link member and said secondary link members each comprise a link member connection portion, and wherein said link member connection portions are sandwiched between said first and second junction portions.

16. The securing device of claim 15, wherein said first and second junction portions are permanently attached.

17. The securing device of claim 15, wherein said first and second junction portions are separable from one another.

18. The securing device of claim 1, wherein said primary and/or secondary link members are removable from said junction so as to be replaceable.

19. The securing device of claim 18, wherein said junction is keyed.

20. A method of securing a plurality of tools and/or other mobile objects using a securing device, comprising:

attaching a primary securing member of a securing device to an anchor object;

attaching each of a plurality of secondary securing members of said securing device to a respective one or more of a plurality of mobile objects;

wherein said securing device comprises said primary securing member, said plurality of secondary securing members, a junction, a primary link member connecting said primary securing member to said junction, and a plurality of secondary link members each connecting a respective one or more of said secondary securing members to said junction, wherein each of said primary link member and said secondary link members comprises a chain or cable.

* * * * *